United States Patent [19]

Taylor

[11] Patent Number: 4,718,205

[45] Date of Patent: Jan. 12, 1988

[54] DWELLING CONSTRUCTION

[76] Inventor: Lawrence H. Taylor, P.O. Box 49-58, 48th St. Sta., Union City, N.J. 07087

[21] Appl. No.: 903,889

[22] Filed: Sep. 4, 1986

Related U.S. Application Data

[63] Continuation of Ser. No. 725,757, Apr. 22, 1985, abandoned.

[51] Int. Cl.[4] ..... E04B 1/34

[52] U.S. Cl. ..... 52/79.8; 52/234; 49/68

[58] Field of Search ..... 52/234, 238.1, 79.6, 52/79.8, 205, 206, 79.4; 49/68, 93, 94, 95

[56] References Cited

FOREIGN PATENT DOCUMENTS

| | | | |
|---|---|---|---|
| 2456620 | 8/1976 | Fed. Rep. of Germany | 52/79.4 |
| 656097 | of 1929 | France | 52/234 |
| 981058 | 5/1951 | France | 52/79.4 |
| 12099 | 12/1924 | Netherlands | 52/234 |

OTHER PUBLICATIONS

"Money-Making Head Gates", Albert V. Krewatch.

*Primary Examiner*—William F. Pate, III
*Assistant Examiner*—Richard E. Chilcot, Jr.
*Attorney, Agent, or Firm*—Kerkam, Stowell Kondracki & Clarke

[57] ABSTRACT

A housing construction comprising a first unit enclosing at least a kitchen, living/dining/bath and sleeping zones, a second unit enclosing at least a kitchen, storage, and laundry facilities with high heat, noise and or pollutant producing characteristics connected by or separated by a confluence of passageways lying between the first the first and second units to connect these units or alternatively to separate these units by forming sealed passageways between other parts of the housing construction to thus permit exchange of or exclusion of warm or cold air, restrict noise, direct or control traffic, and/or provide increased security as required to produce more security comfort and convenience for the occupants and house guests in the most economical and efficient manner.

2 Claims, 7 Drawing Figures

DWELLING CONSTRUCTION

This is a continuation of application Ser. No. 725,757, filed Apr. 22, 1985, now abandoned.

This invention relates to a housing construction comprising a first unit enclosing at least living/dining, sleeping, bath, and kitchen zones, and a second unit enclosing at least storage, cooking and laundry facilities having high heat or noise or pollutant producing characteristics, with the two units being alternatively connected to one another, or separated from one another by a variable confluence of pathways opened or closed at will by doors to a passage between units that will seal a passage to outside weather or separate units and connect other house areas to each other to accommodate or facilitate the varying optimum traffic patterns of the house in that manner to most efficiently save heat in cold weather and conserve air-conditioning in hot weather, or to prevent noise, cooking odor and other forms of pollution and/or lack of privacy in the first unit.

BACKGROUND OF THE INVENTION

Housing construction has evolved over the centuries from simple single room structures to the modern multi-room dwellings of today. The evolution has evolved to where the modern house contains a plurality of separate or basically separate rooms arranged for maximum comfort, accessability convenience and privacy of the occupants. In general the basic rooms comprise sleeping areas, bathing areas, work and/or storage areas, cooking and dining areas, entertaining and recreation areas and utility zones housing the primary heating and cooling systems. In such housing layouts little if any provisions have been made in the past by variable passageway/connections for maximum utilization of energy for heating and cooling consistant with desirable traffic patterns which today should be a major consideration in view of current high energy costs.

THE PRESENT INVENTION

It is a principal object of the present invention to provide a housing construction which maximizes energy conservation without any loss and in some cases provides improvement in convenience and privacy of multiple room housing construction.

In general the present invention comprises housing construction comprising a first unit enclosing at least a kitchen, living/dining zone(s) and sleeping and bathing zones, a second unit enclosing at least an auxilliary kitchen and laundry having high heat or noise or pollutant producing characteristics, a confluence of passageways connecting the first and the second units and providing access to adjacent garage, porch and entrance areas, said pasageways including first and second doors, the first door selectively closing one end of the passageway means to the first unit from the second unit in a first position and closing the passageway means from essentially the outside, garage or porch in a second position and the second door selectively closing the other end of the passageway mean to the second unit in one position and closing the passageway means from the outside in a second position.

BRIEF DESCRIPTION OF THE DRAWING

The invention will be more particularly described in reference to the accompanying drawings wherein.

DETAILED DESCRIPTION OF THE INVENTION

Figure 1:
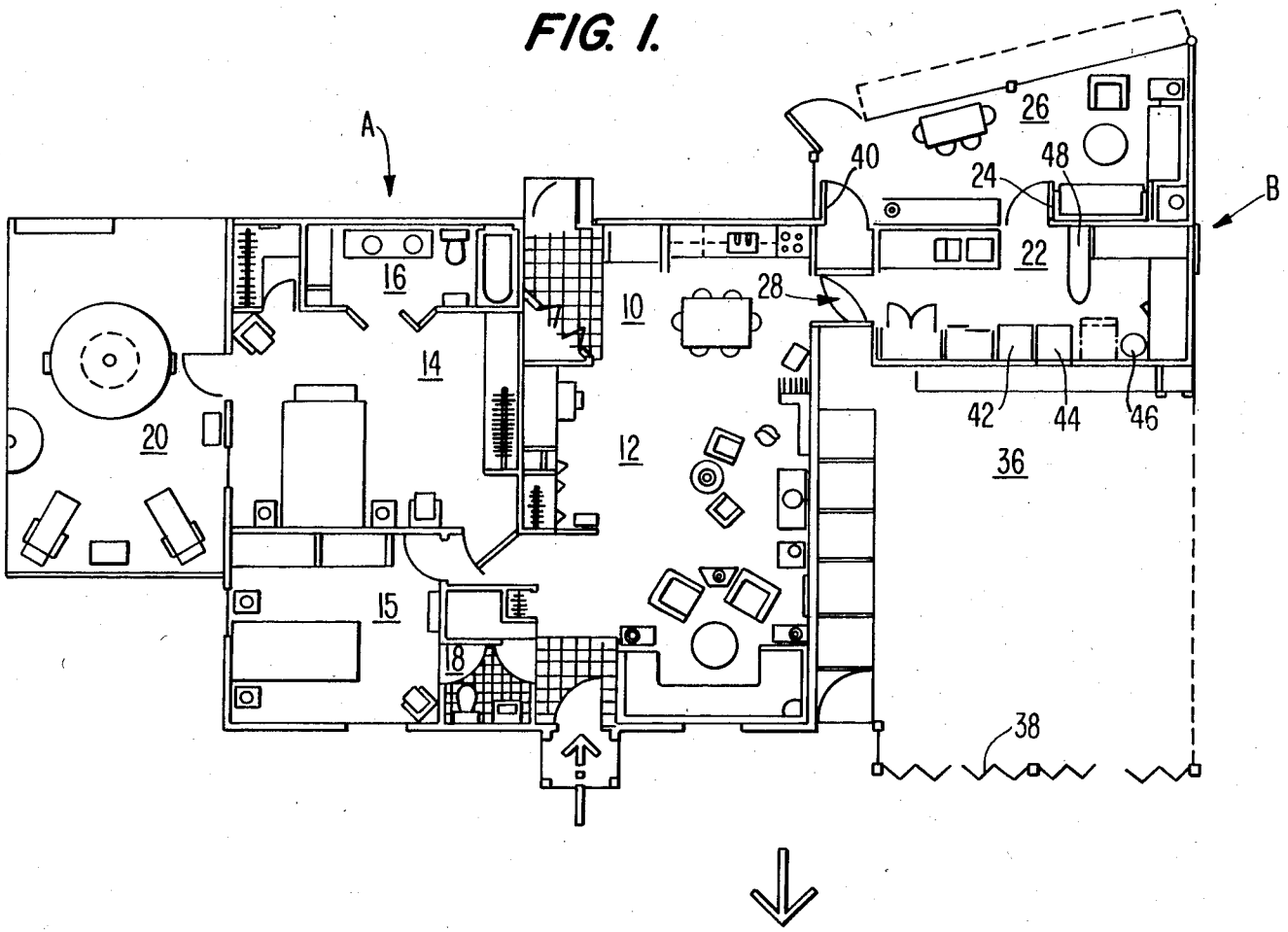
FIG. 1 is a plan view of a dwelling constructed in accordance with the teachings of the present invention.

Referring to the drawing the dwelling comprises two primary zones designated A and B. Zone A comprises the major living area of the dwelling and includes at least a kitchen area 10, a living/recreation area 12, sleeping areas 14 and 15, and bathing areas such as illustrated at 16 and 18. The main zone A may also contain a patio 20.

The second zone B comprises at least an auxiliary kitchen and laundry area 22. The auxilliary kitchen bookshelf 42, storage 44, snack bar 46 and screened porch 26. Zones A and B are connected by a confluence of passageways generally designated 28 and shown in enlarged detail in the FIG. 2A–F. The confluence of passageways 28 comprises a through passage 30 connecting by door means 32 to Zone A and door means 34 to zone B. With the doors 32 and 34 closing the passageway means 28 between zones A and B the passageway 30 is open for entry into for example a carport 36 having an entrance and exit 38 for vehicles. Further the passage 30 communicates with the screen porch 26 via door 40. Door 32 is hinged as at 50 and door 34 is hinged as at 50'. As to be more fully discussed the hinges 50 and 50 may be placed on the opposite ends of the doors 32 and 34 depending on the desires of the occupant.

Figure 2A:
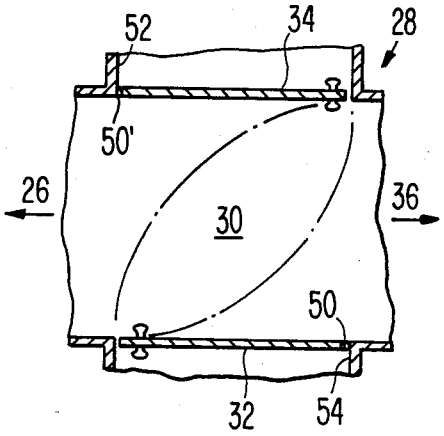
FIGS. 2A, B, C, D, E and F are enlarged plan views of the confluence of passageways connecting to primary zones of the dwelling illustrated in FIG. 1 with the pair of doors in six major positions.
Figure 2B:
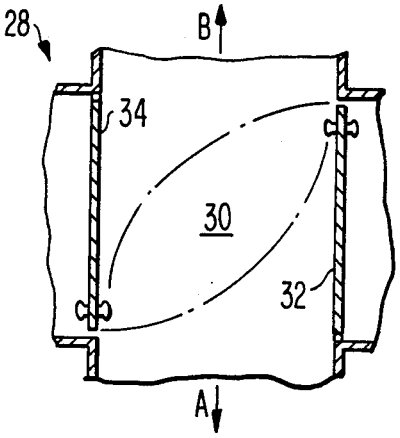

In FIG. 2B complete communication without opening doors is provided between zones A and B which would be an excellent arrangement for the doors during the cold or cooler seasons when the heat produced in the auxiliary kitchen is used to supplement the heat in zone A.

Figure 2C:
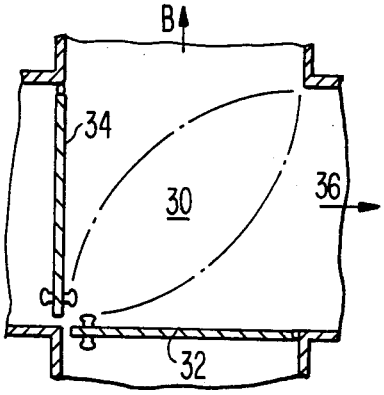

Referring to FIG. 2C the doors are positioned such that there is an unobstructed entrance between the garage and the auxiliary kitchen zone B. This arrangement of doors would be useful either summer or winter when provisions are being brought into the auxiliary kitchen.

Figure 2D:
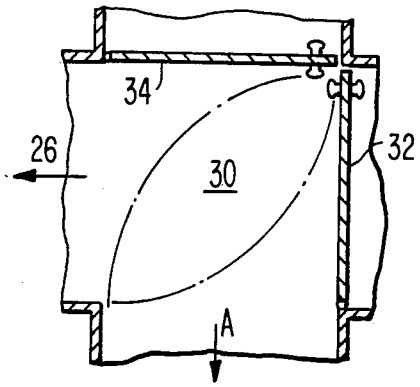

Referring to FIG. 2D the doors are arranged for through passage from zone A the primary living area to the summer porch 26 and the back yard of the dwelling.

Figure 2E:
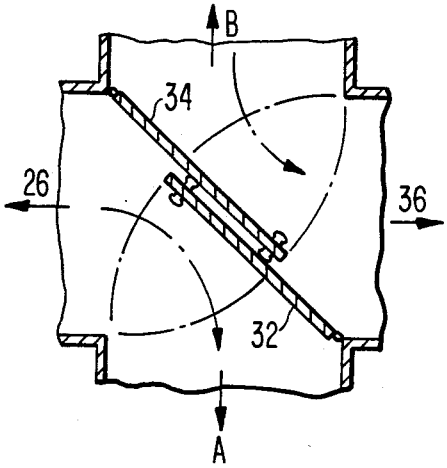
Figure 2F:
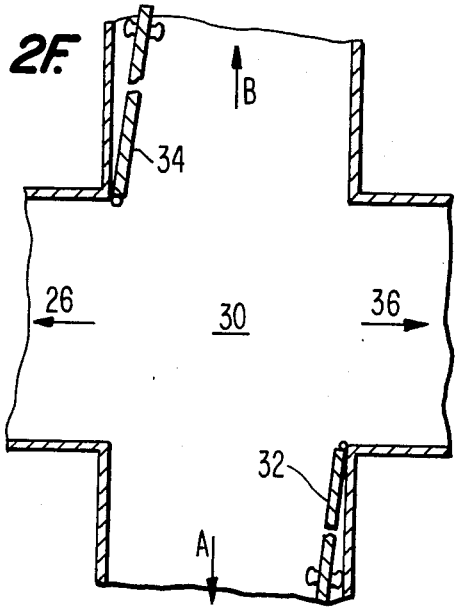

FIG. 2E shows the doors arranged to permit a combination of traffic flow illustrated in FIGS. 2C and 2D. As hereinbefore stated if the hinges 50 and 50' were reversed then a combination of passage directly from zone A into the garage area and from the auxiliary kitchen to the porch would be permissible. The four diagrams FIGS. 2A–2E illustrate doors hung with conventional hinges. Where the hinges permit the doors to lie flat against the wall nine additional arrangements of the pair of doors is possible. Referencing FIG. 2F one of said additional arrangements is illustrated wherein door 34 is against wall 52 and door 32 is against wall 54 completely opening the confluence of passageways.

From the foregoing description it will be apparent to those skilled in the art that employing the cost passages and two doors provides the dwelling occupants with a wide choice of door arrangements for various seasonal conditions and traffic flow arrangements without materially increasing the cost of the overall dwelling.

While not mentioned herein before the living space of zone A, zone B and the confluence of passageway means 28 are roofed for protection against the elements.

From the foregoing description it will be recognized that the housing construction herein before described comprises a novel arrangement through a confluence of passageway means providing optimum variable passageway and living and congregation spaces and providing optimum energy use/conservation facilities. It will be recognized by those skilled in the art that the arrangement of rooms in zone A and the arrangement of fixtures or divisions in zone B may be materially altered as long as the confluence of passageway means 28 remains basically unchanged.

Having described a preferred embodiment of my invention I claim:

1. A housing construction comprising a first unit enclosing at least a kitchen, living zone, and sleeping and bathing zones, a second unit enclosing at least an auxillary kitchen and laundry having high heat, noise and pollutant producing characteristics, an outside porch and a garage area, a confluence of four passageways connecting the first and second units as well as said outside porch and garage area, the said passageways including first and second doors, said first and second doors having first, second, third, and fourth positions, said first door in said first position closing the passageway to said second unit, said second door in said first position closing the passageway to said first unit, said first and second doors in said second positions connecting said first and second units and closing access to said outside porch and to said garage area; said first door in said second position and said second door in said first position opening the second unit through the passageways to the garage area; said first door in said first position and said second door in said second position opening the first unit to said outside porch; said first and second doors in said third position the first and second units are each open to each other and open to the outside porch, and to the garage area, and said first and second doors in said fourth position opening the first unit to the outside porch and opening said second unit to the garage area and closing access between the first an second units.

2. The invention defined in claim 1 further wherein said passageway means has a length and width not less than the width of the first and second doors.

* * * * *